US009546842B2

(12) United States Patent
Vézain et al.

(10) Patent No.: US 9,546,842 B2
(45) Date of Patent: Jan. 17, 2017

(54) DEVICE FOR LAUNCHING A PROJECTILE USING A COMPRESSED FLUID

(71) Applicant: THALES, Courbevoie (FR)

(72) Inventors: Stéphane Vézain, Mandelieu (FR); Carole Billot, Cannes la Bocca (FR); Didier Stanek, Cannes la Bocca (FR); Yannick Baudassé, Cannes la Bocca (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 14/957,386

(22) Filed: Dec. 2, 2015

(65) Prior Publication Data

US 2016/0161211 A1 Jun. 9, 2016

(30) Foreign Application Priority Data

Dec. 5, 2014 (FR) ..... 14 02779

(51) Int. Cl.

| | |
|---|---|
| ***F41B 11/60*** | (2013.01) |
| ***F41G 7/32*** | (2006.01) |
| ***F41B 11/83*** | (2013.01) |
| *F42B 15/04* | (2006.01) |

(52) U.S. Cl.

CPC ..... *F41B 11/60* (2013.01); *F41B 11/83* (2013.01); *F41G 7/32* (2013.01); *F42B 15/04* (2013.01)

(58) Field of Classification Search

CPC ..... F41B 11/60; F41B 11/00; F41B 11/62; F41B 15/04; F41B 11/83; F42B 12/68

USPC ..... 124/69; 43/6; 102/504; 89/1.34; 42/1.13

See application file for complete search history.

(56) References Cited

U.S. PATENT DOCUMENTS

| | | | | | |
|---|---|---|---|---|---|
| 2,090,731 | A * | 8/1937 | Klein | F41B 11/68 | 124/69 |
| 2,469,533 | A * | 5/1949 | Wellcome | H02G 1/04 | 102/504 |
| 2,703,944 | A * | 3/1955 | Molyneux | F42B 30/14 | 124/73 |
| 2,923,286 | A * | 2/1960 | Draganti | F41B 11/83 | 124/31 |
| 3,015,182 | A * | 1/1962 | Tuttle | A01K 91/02 | 43/19 |
| 3,153,875 | A * | 10/1964 | Califano | F41B 11/83 | 102/371 |
| 3,419,991 | A * | 1/1969 | Mitchell | A01K 91/02 | 43/19 |
| 3,523,538 | A * | 8/1970 | Kunio | F41B 15/04 | 124/67 |
| 3,583,087 | A * | 6/1971 | Huebner | F42B 12/68 | 102/530 |

(Continued)

*Primary Examiner* — John D Cooper

(74) *Attorney, Agent, or Firm* — Baker & Hostetler LLP

(57) ABSTRACT

A device for launching using compressed fluid, comprises: a projectile, a barrel having two ends, the projectile being positioned inside the barrel, a first of the two ends allowing the compressed fluid to enter the barrel, a second of the two ends allowing the projectile to leave, a reservoir of compressed fluid connected to the first of the two ends of the barrel. A connecting device comprises a first tape, able to make the transition from a configuration in which it is wound about an axis Z around a support to a configuration in which it is deployed along an axis X substantially perpendicular to the axis Z, the tape having an end fixed to the projectile, and wherein the support is fixed in the barrel.

1 Claim, 10 Drawing Sheets

(56) References Cited

U.S. PATENT DOCUMENTS 3,780,720 A * 12/1973 Alderson ..... A01K 81/00 124/31
3,888,033 A * 6/1975 Fima ..... A01K 81/00 43/6
4,031,840 A * 6/1977 Boisrayon ..... B63C 7/16 114/312
4,077,349 A * 3/1978 Paul ..... B63B 21/00 114/230.25
4,110,929 A * 9/1978 Weigand ..... A01K 91/02 124/57
4,155,342 A * 5/1979 Traweek ..... F41B 7/003 119/805
5,029,772 A * 7/1991 Redford ..... B65H 49/34 102/504
5,086,749 A * 2/1992 Ekstrom ..... F41B 11/83 124/56
5,174,384 A * 12/1992 Herman ..... A62C 31/00 102/504
5,398,587 A * 3/1995 Kornblith ..... F42B 12/68 102/504
5,566,858 A * 10/1996 Ducker, III ..... A01K 81/06 222/192
5,909,000 A * 6/1999 Rakov ..... F41B 11/62 102/440
6,244,261 B1 * 6/2001 West, Jr. ..... F41B 11/62 102/504
6,811,503 B2 * 11/2004 May ..... A01K 81/00 43/6
2002/0053278 A1 * 5/2002 Hayes ..... B63C 9/26 89/1.34
2004/0173197 A1 * 9/2004 Moffitt ..... F41B 11/83 124/74
2009/0159065 A1 * 6/2009 Moffitt ..... A01K 81/00 124/71
2015/0168115 A1 * 6/2015 Higham ..... B63C 9/26 89/1.34
2016/0024790 A1 * 1/2016 Baudasse ..... E04C 3/005 52/108

* cited by examiner

DEVICE FOR LAUNCHING A PROJECTILE USING A COMPRESSED FLUID

CROSS-REFERENCE TO RELATED APPLICATION

This application claims priority to foreign French patent application No. FR 1402779, filed on Dec. 5, 2014, the disclosure of which is incorporated by reference in its entirety.

FIELD OF THE INVENTION

The present invention relates to a device for launching a projectile using a compressed fluid. The invention notably applies to the field of space.

BACKGROUND

The amount of space debris, of fairly substantial size, is constantly increasing. The increase in the amount of space debris is leading to an increase in the risk of collisions between satellites and/or with a space station. Some debris is considered to be critical because of its size and/or its position in zones referred to as at risk zones, for example a usable orbit. Mention may, for example, be made of scrapped satellites, rocket stages, which may be stationed in a usable orbit. Getting such debris out of orbit becomes an urgent matter in order to move them away from the usable orbit. The question then arises of how to remove this debris in order to reduce space pollution in a way that is effective and reliable. Indeed, reliable manoeuvres and equipment are needed in order to remove the debris otherwise undesired collisions and even more debris will result.

Various solutions have been suggested. Of these mention may be made of an articulated arm for seizing hold of the debris, a gigantic net or a robotic vehicle, all intended to capture the debris and return it to earth or to park it in an orbit referred to as a parking orbit, far removed from the usable orbits. These solutions are expensive and difficult to implement.

Another solution is to harpoon the target object in question, namely the debris, in order to tow it out of the at-risk zone. One major problem is with the stability of the harpoon. Indeed, the earth's atmosphere, that can be considered to behave like a viscous medium, generates air resistance. By contrast, in space, which is to say in a near-perfect vacuum, an object moving in that medium is almost completely free of air resistance. The result of this is that there is no aerodynamic effect on this object. In other words, in a vacuum, it is not possible to rely on the aerodynamic effects in order to keep the harpoon orientated along the axis of its path. Once launched, the harpoon, generally held by a cable, therefore no longer heads in the desired direction towards the target object. Additional constraints associated with the field of space have therefore to be taken into consideration when coming up with the solution for the device intended to harpoon the target object. In addition, the connection between the harpoon and the target object (i.e. the debris) can create disturbances in the path of the harpoon when the cable is unwound. And the cable can also become tangled when it is stored therein.

SUMMARY OF THE INVENTION

The invention seeks to alleviate all or some of the above-mentioned problems by proposing a device for launching a projectile using a compressed fluid which allows the projectile to maintain its trajectory along its line of sight, the projectile being connected by means of a connecting device which does not generate disturbances on the path of the projectile.

To this end, one subject of the invention is a device for launching a projectile using compressed fluid, comprising:

a barrel having two ends, the projectile being positioned inside the barrel, a first of the two ends allowing the compressed fluid to enter the barrel, a second of the two ends allowing the projectile to leave, a reservoir of compressed fluid connected to the first of the two ends of the barrel, characterized in that it comprises a connecting device comprising a first tape, able to make the transition from a configuration in which it is wound about an axis Z around a support to a configuration in which it is deployed along an axis X substantially perpendicular to the axis Z, the tape having an end fixed to the projectile, and in that the support is fixed in the barrel.

According to one embodiment, the end of the first tape is connected to the projectile by a connection element, and the connection element is a mechanical component allowing the projectile to rotate about the axis X.

BRIEF DESCRIPTION OF THE DRAWINGS

The invention will be better understood and other advantages will become apparent from reading the detailed description of one embodiment given by way of example, which description is illustrated by the attached drawing in which.

For the sake of clarity, in the various figures the same elements will bear the same references.

DETAILED DESCRIPTION

It should be noted that the invention is described in the context of use in the field of space. Nevertheless, it may also be applied in the earth's atmosphere, for example on a ship for recovering debris from the water or floating on the surface of the water or on land for towing an object.

And more generally, the invention can be applied in any scenario where a first object is connected to a second object.

Figure 1:
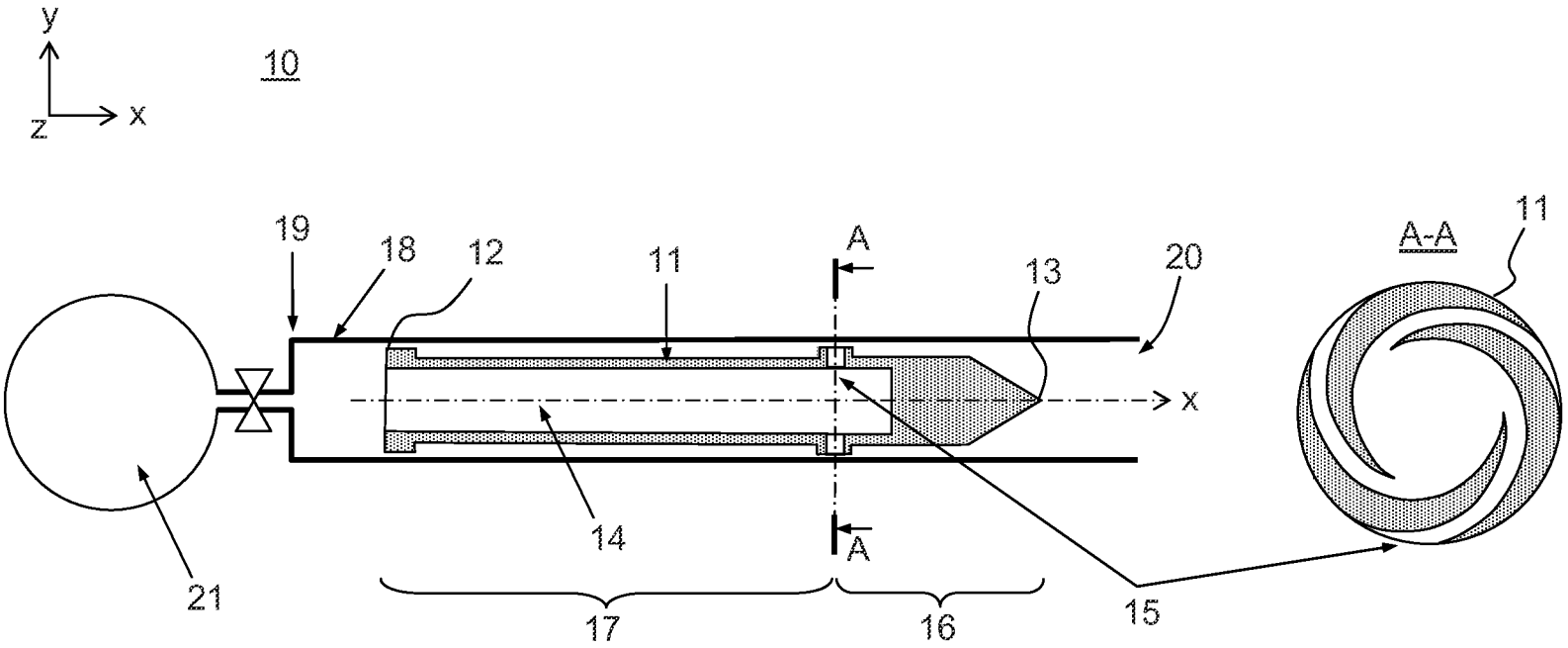
FIG. 1 shows a cross-sectional schematic in a plane XY of a first embodiment of a device for launching a projectile according to the invention, and a cross-sectional view of the projectile on a plane YZ perpendicular to the plane XY.

FIG. 1 shows a cross-sectional schematic in a plane XY of a first embodiment of a device 10 for launching a projectile 11 and of a barrel 18, and a cross-sectional view of the projectile 11 in a plane YZ perpendicular to the plane XY. The projectile 11 extends along an axis X between two ends 12, 13. The projectile 11 is intended to be positioned in the barrel 18 of substantially cylindrical shape of axis X. The projectile 11 comprises a hollow part 14 at its centre opening onto a first 12 of the two ends of the projectile 11, and which is intended to receive a compressed fluid. The projectile 11 comprises a plurality of vents 15 passing through the projectile 11 from the hollow part 14 substantially perpendicular to the axis X and with a substantially radial outlet intended to expel the compressed fluid substantially at a tangent to the projectile 11. For preference, although this is not compulsory, the compressed fluid may be a compressed gas. The compressed fluid enters the projectile 11 via the hollow part 14 and leaves at a tangent to the cross section of the projectile 11 via the vents 15. The compressed fluid leaving at a tangent to the cross section of the projectile 11 via the vents 15 creates a torque on the projectile which causes it to revolve on itself. In other words, the projectile 11 is set in rotation on itself, about the axis X. On entering the projectile 11, the compressed fluid leads to an increase in the pressure inside the projectile. This increase in pressure causes a translational movement of the projectile along the axis X, allowing the projectile 11 to be propelled. At the same time, the pressure of the fluid and the flow of the fluid through the vents cause the projectile to rotate on itself. Thus, the hollow part 14 and the vents 15 of the projectile 11 allow both a translational movement along the axis X and a rotational movement about the axis X of the projectile 11. In the view in section in the plane YZ of FIG. 1, the projectile 11 comprises 3 vents. For the projectile 11 to be set in rotation adequately, at least two vents are required, but it is equally possible to have three or more vents.

The projectile 11 comprises a head 16 and a body 17. The head 16 of the projectile 11 extends from a second 13 of the two ends of the projectile 11 as far as the plurality of vents 15. The body 17 of the projectile 11 extends from the head 16 as far as the first end 12 of the projectile 11.

The barrel 18 has two ends 19, 20 in which the projectile 11 is positioned, a first 19 of the two ends of the barrel 18 allowing the compressed fluid to enter the barrel 18, a second 20 of the two ends allowing the projectile 11 to leave.

Finally, the device 10 for setting the projectile 11 in rotation comprises a reservoir 21 of compressed fluid connected to the first end 19 of the barrel 18 in which the projectile 11 is situated, so as to supply the projectile 11 with compressed fluid.

Figure 2A:
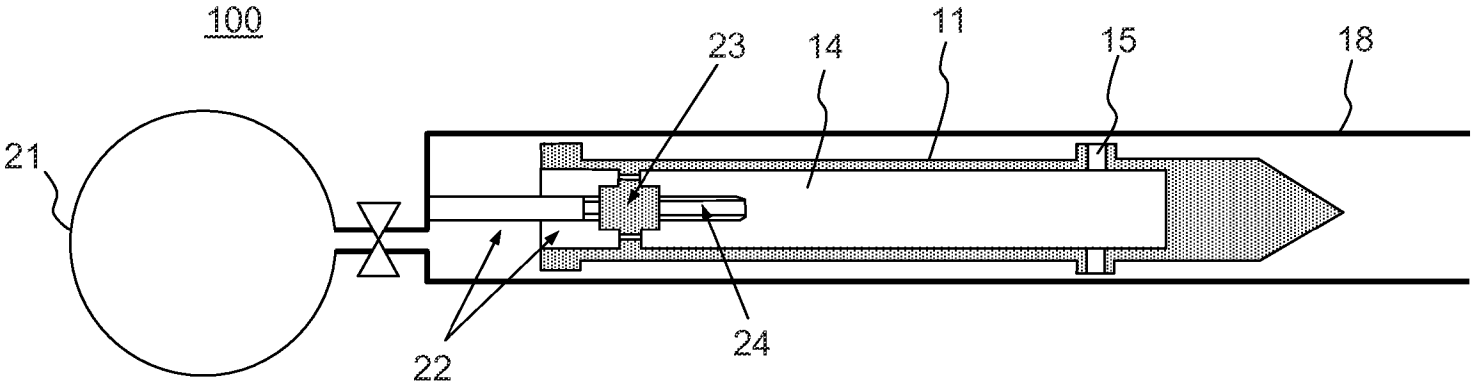
FIGS. 2*a* and 2*b* show cross-sectional schematics in the plane XY of a second embodiment of a device for launching the projectile according to the invention.
Figure 2B:
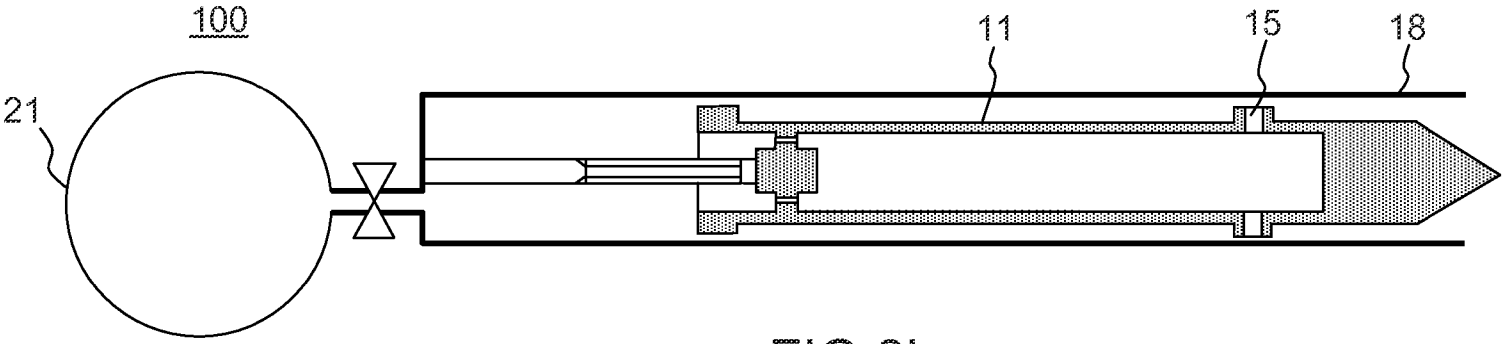

FIGS. 2*a* and 2*b* show cross-sectional schematics in the plane XY of a second embodiment of a device 100 for launching the projectile 11. The barrel 18 comprises a first 23 of two helical-connection elements 23, 24. The projectile 11 comprises a second 24 of two helical-connection elements 23, 24 which is fixed in the hollow part 14 of the projectile 11, the first 23 and the second 24 helical-connection elements forming a combined-movement mechanism 22 so as simultaneously to generate a rotation about the axis X and a translation along the axis X of the projectile 11 with respect to the barrel 18. The combined-movement mechanism 22 may be a screw-nut assembly or, for preference, an assembly comprising a ball screw or a roller screw so as to limit friction between the two connecting elements 23, 24. The pressure of the compressed fluid drives the projectile 11 out of the barrel 18. As we saw previously, the vents 15 with a substantially radial outlet allow the generation of a rotational movement about the axis X of the projectile 11. Now, as it is desirable for the projectile to keep its trajectory on its axis, the trajectory being along the axis X, it is desirable for the projectile to be adequately accelerated in rotation about its axis X so that it always remains oriented in the same direction. One of the two elements 23 or 24 can be likened to a threaded rod and the other of the two elements 23 or 24 can be likened to a nut. Depending on the number N of threads over which the nut is engaged with the threaded rod, the projectile 11 will affect the same number N of revolutions on itself, therefore a movement of N rotations, as depicted in FIG. 2*a*, before being freed in translation and being able to be ejected, as depicted in FIG. 2*b*. The connecting mechanism 22 therefore allows the projectile 11 to acquire greater angular acceleration about the axis X before accelerating in a translational movement along the axis X.

It should be noted that in FIGS. 2*a* and 2*b* the screw is fixed to the barrel 18 and the nut in the hollow part 14 of the projectile 11. Nevertheless, it is entirely possible to reverse this arrangement, namely to fix the screw in the hollow part 14 of the projectile 11 and the nut to the barrel 18.

Figure 3:
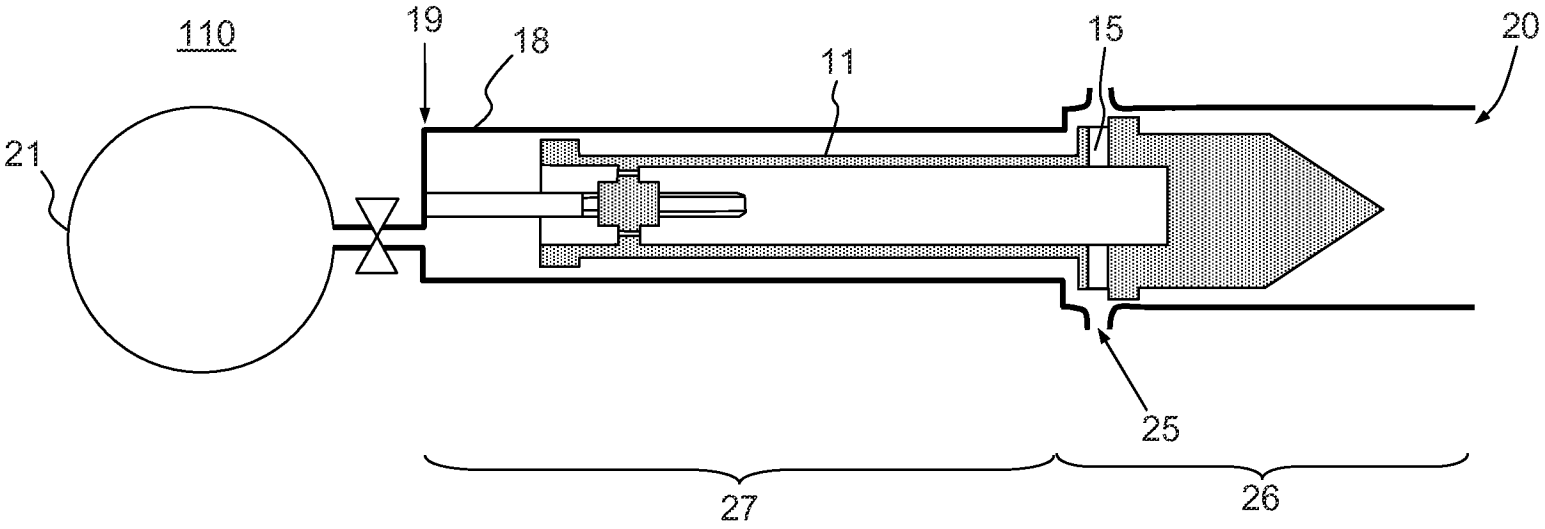
FIG. 3 shows a cross-sectional schematic in the plane XY of a third embodiment of a device for launching the projectile according to the invention.

FIG. 3 shows a cross-sectional schematic in the plane XY of a third embodiment of a device 110 for launching the projectile 11 comprising the barrel 18. The barrel 18 comprises a substantially radial first opening 25. This substantially radial opening 25 allows the compressed fluid to leave the barrel 18 after it has flowed through the projectile 11.

The barrel 18 comprises a head 26 and a body 27, the head 26 of the barrel 18 extending from the second 20 of the two ends of the barrel 18 as far as the opening 25, the body 27 of the barrel 18 extending from the head 26 of the barrel 18 as far as the first 19 of the two ends of the barrel 18.

It may also be noted that the diameter of the body 27 of the barrel 18 is smaller than the diameter of the head 26 of the barrel 18. In addition, the diameter of the body 17 of the projectile 11 is smaller than the diameter of the head 16 of the projectile 11. Further, the diameter of the body 17 of the projectile 11 is smaller than the diameter of the body 27 of the barrel 18 and the diameter of the head 16 of the projectile 11 is smaller than the diameter of the head 26 of the barrel 18.

In other words, the diameter of the head 26 of the barrel 28 is substantially larger than the diameter of the head 16 of the projectile 11, and the diameter of the body 27 of the barrel 18 is substantially larger than the diameter of the body 17 of the projectile 11.

This difference in diameter between the bodies and the heads respectively constitutes a guidance system for the projectile 11. Specifically, because the bodies correspond to a first diameter that is smaller than a second diameter corresponding to that of the heads, as the projectile 11 is ejected it becomes free at body and head level simultaneously. This configuration thus avoids any disturbance in the trajectory of the projectile 11 that could be generated by vibrations at the barrel.

Figure 4A:
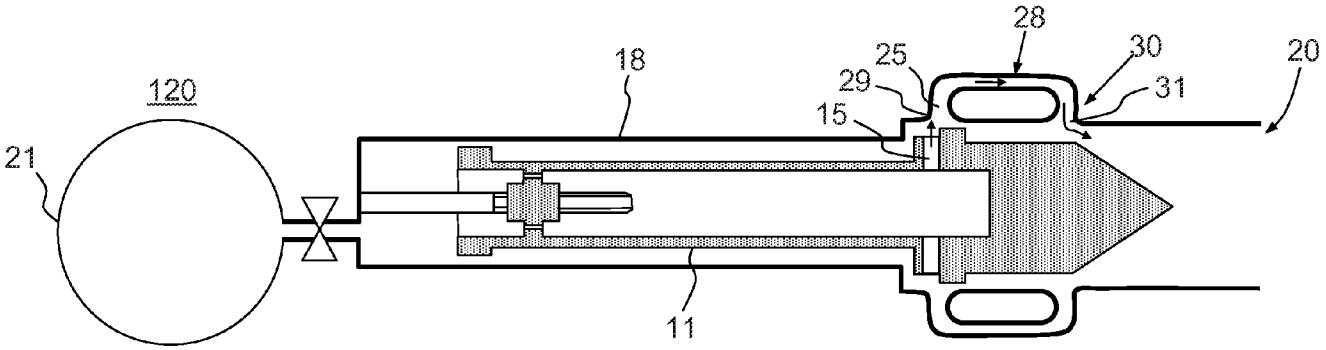
FIGS. 4*a* and 4*b* show cross-sectional schematics in the plane XY of a fourth embodiment of a device for launching the projectile and comprising the barrel.
Figure 4B:
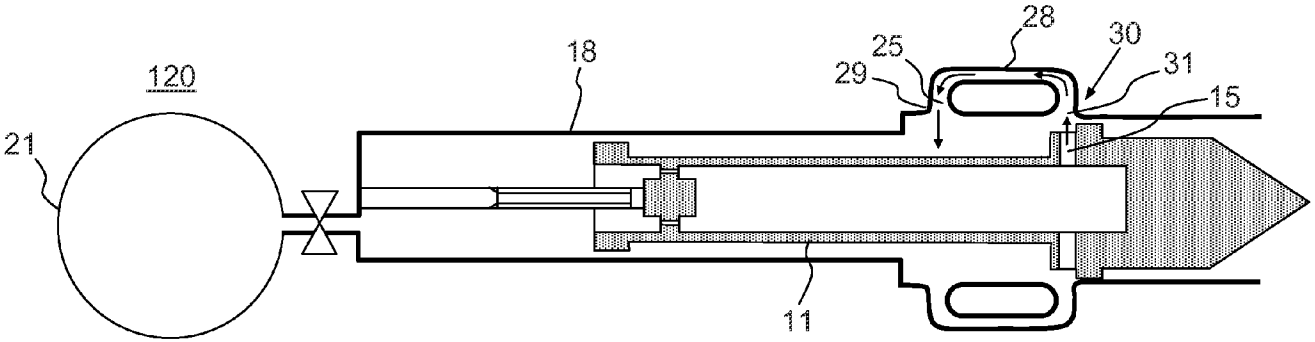

FIGS. 4*a* and 4*b* show cross-sectional schematics in the plane XY of a fourth embodiment of a device 120 for launching the projectile 11 comprising the barrel 18. The barrel 18 comprises a discharge duct 28 having two ends 29, 30. The barrel 18 comprises a second opening 31 between the first opening 25 of the barrel 18 and the second 20 of the two ends of the barrel 18. A first 29 of the two ends of the discharge duct 28 is connected to the first opening 25 of the barrel 18 and a second 30 of the two ends of the discharge duct 28 is connected to the second opening 31 of the barrel 18. The compressed fluid, which will be at a certain pressure and have a certain flow rate, will need, having passed through the projectile 11, to be discharged from the barrel 18. As explained previously in conjunction with FIG. 3, the compressed fluid may simply be discharged through the radial opening 25 of the barrel 18. In that case, the compressed fluid is released to the outside (space, the atmosphere, i.e. the environment in which the device for setting the projectile in rotation is being used). It is also possible to use the discharge of the compressed fluid to generate an aerodynamic effect on the projectile 11, as shown in FIGS. 4*a* and 4*b*. In FIG. 4*a*, the projectile 11 is in a phase of angular acceleration. The combined-movement mechanism 22 encourages the rotational acceleration of the projectile 11 and the radial opening 25 lies more or less facing at least one vent 15. The compressed fluid leaves the projectile 11 via the vent, generates a torque on the projectile 11 and causes it to revolve on itself. The compressed fluid then enters the discharge duct 28 via the first end 29 (namely via the radial opening 25) and re-emerges from the discharge duct 28 via the second end 30 (namely the second opening 31). As depicted in FIG. 4*b*, in the phase of translational movement along the axis X, because the connecting elements 23, 24 of the combined-movement mechanism 22 are free of one another, namely because the projectile 11 has acquired sufficient angular acceleration, the projectile 11 moves towards the end 20 of the barrel 18. The vents 15 therefore find themselves facing the second end 30 of the discharge duct 28. The compressed fluid therefore enters the discharge duct 28 via the second end 30 and re-emerges from the discharge duct 28 via the radial opening 25 at the level of the first end 29 of the discharge duct 28. The flow of the compressed fluid towards the body 27 of the barrel 18 will generate an increase in pressure in the body 27 of the barrel 18 and thus generate an additional force on the projectile in the direction of the axis X, encouraging the translational acceleration of the projectile 11 along the axis X.

Figure 5:
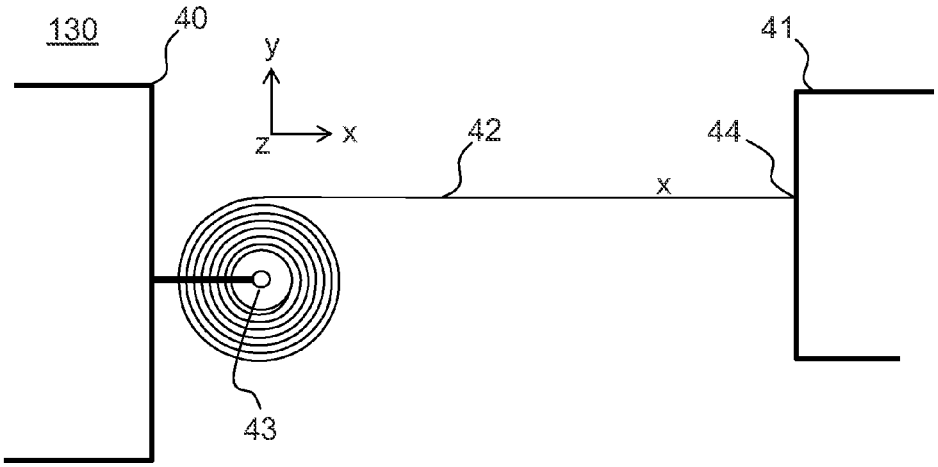
FIG. 5 shows a cross-sectional schematic in the plane XY of a first embodiment of a connecting device intended to connect a first object to a second object.

FIG. 5 shows a cross-sectional schematic in the plane XY of a first embodiment of a connecting device 130 comprising a first object 40, a second object 41. The connecting device 130 comprises a first tape 42, able to make the transition from a configuration in which it is wound about an axis Z around a support 43 fixed to the first object 40 to a configuration in which it is deployed along an axis X substantially perpendicular to the axis Z, the tape 42 having an end 44 intended to come into contact with the second object 41, so as to connect the first object 40 and the second object 41.

A tape is easily wound and unwound, occupying a minimal amount of space in the wound configuration, because it is wound about the axis Z and substantially in the plane XY, thereby preventing the tape from becoming entangled. Nevertheless, it is also possible to contemplate the use of a cable or a spring in the place of the tape, the cable or the string, just like the tape 42, being able to make the transition from a configuration in which it is wound about the axis Z around the support 43 fixed to the first object 40 to a configuration in which it is deployed along the axis X.

Figures 6A, 6B:
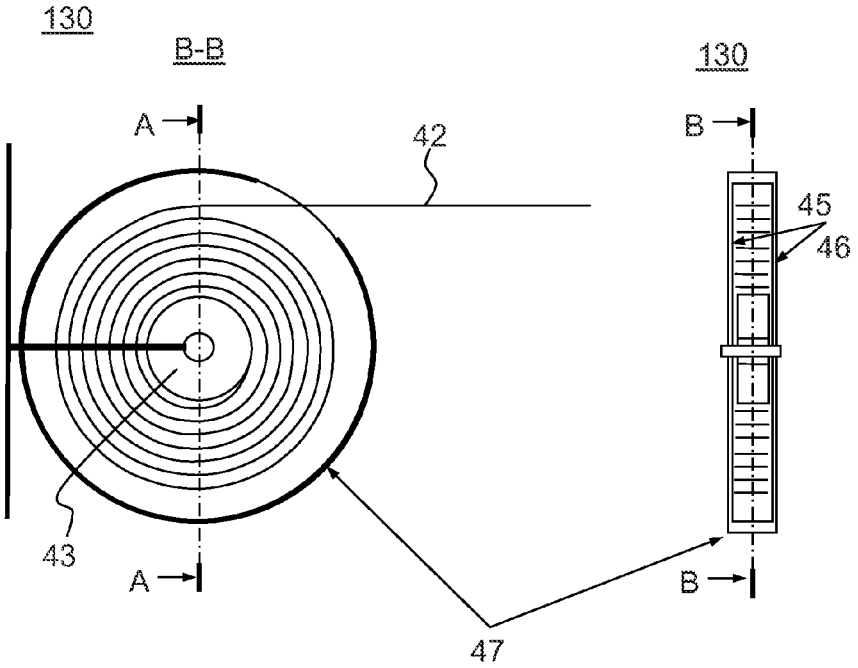
FIGS. 6*a* and 6*b* show cross-sectional schematics in the plane XY of a second embodiment of the connecting device.

FIGS. 6*a* and 6*b* show cross-sectional schematics in the plane XY of a second embodiment of the connecting device 130. The connecting device 130 comprises a first flange 45 and a second flange 46 which flanges are positioned substantially parallel to the plane XY, one on each side of the first tape 42, and a cover 47 positioned around the first tape 42. The two flanges 45, 46 allow the tape 42 not to come out of its winder as the tape 42 unwinds. The cover 47 also prevents the tape 42 from unwinding too much. This is because it is sometimes necessary to have a certain length of tape 42 rapidly available to come into contact with the second object 41 or to tow it. In that case, it may be necessary to unwind the tape 42, for example five to twenty meters of tape 42 from between the two flanges 45, 46 and the cover 47 allows this unwound length to be kept around the support 43. These examples may be seen in FIGS. 7*a* and 7*b*.

Figure 7A:
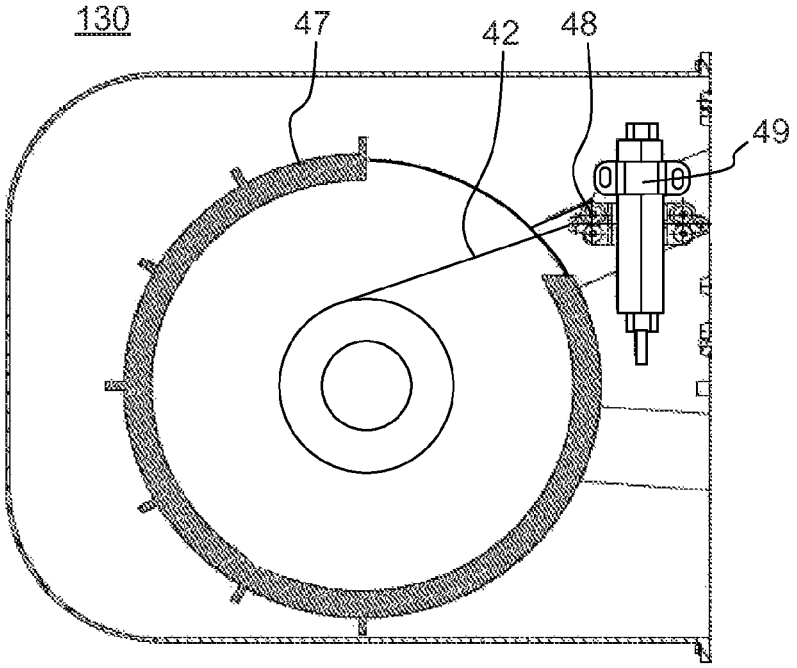
FIGS. 7*a* and 7*b* show cross-sectional schematics in the plane XY of a third embodiment of the connecting device.
Figure 7B:
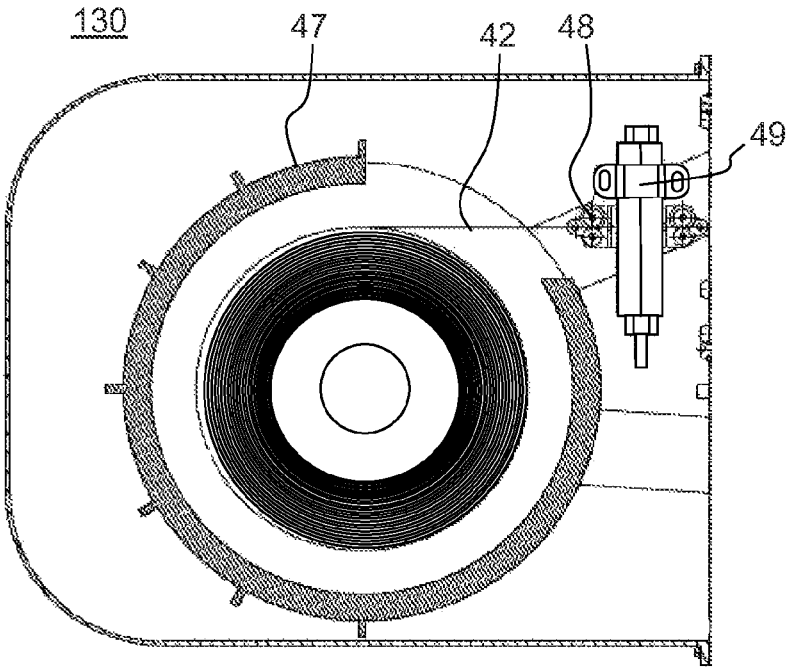

FIGS. 7*a* and 7*b* show cross-sectional schematics in the plane XY of a third embodiment of the connecting device. The connecting device 130 comprises a guide device 48 for guiding the first tape 42. The guide device 48 may consist of two simple rests one on each side of the tape 42 to guide it in its deployment. The simple rests may be rollers forming a point contact with the tape 42 or fingers forming a longitudinal connection across the width of the tape 42.

Furthermore, the connecting device 130 may comprise a cutting device 49 intended to cut the first tape 42. Such a cutting device may prove necessary if there is no longer a desire to come into contact with the second object or if, for safety or manoeuvrability reasons there is no longer a desire to continue with the towing. The cutting device may be a pyro shears or any other suitable type of shears.

Figure 8:
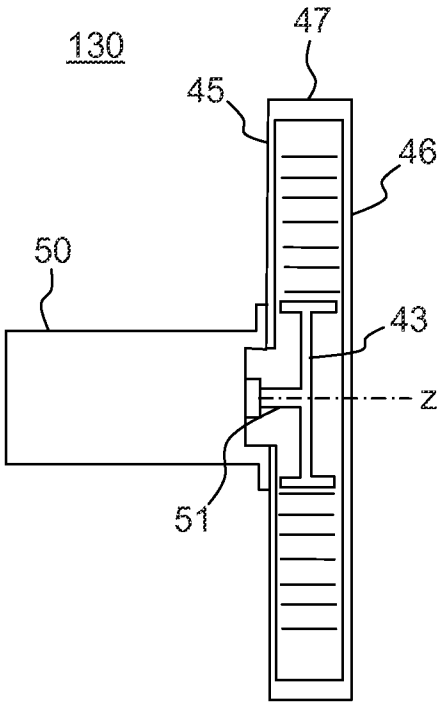
FIG. 8 shows a cross-sectional schematic in the plane XY of a fourth embodiment of the connecting device.

FIG. 8 shows a cross-sectional schematic in the plane XY of a fourth embodiment of the connecting device 130. The connecting device 130 may further comprise a motor 50 having an output shaft 51 along the axis Z connected to the support 43 and intended to wind and deploy the first tape 42.

Figure 9:
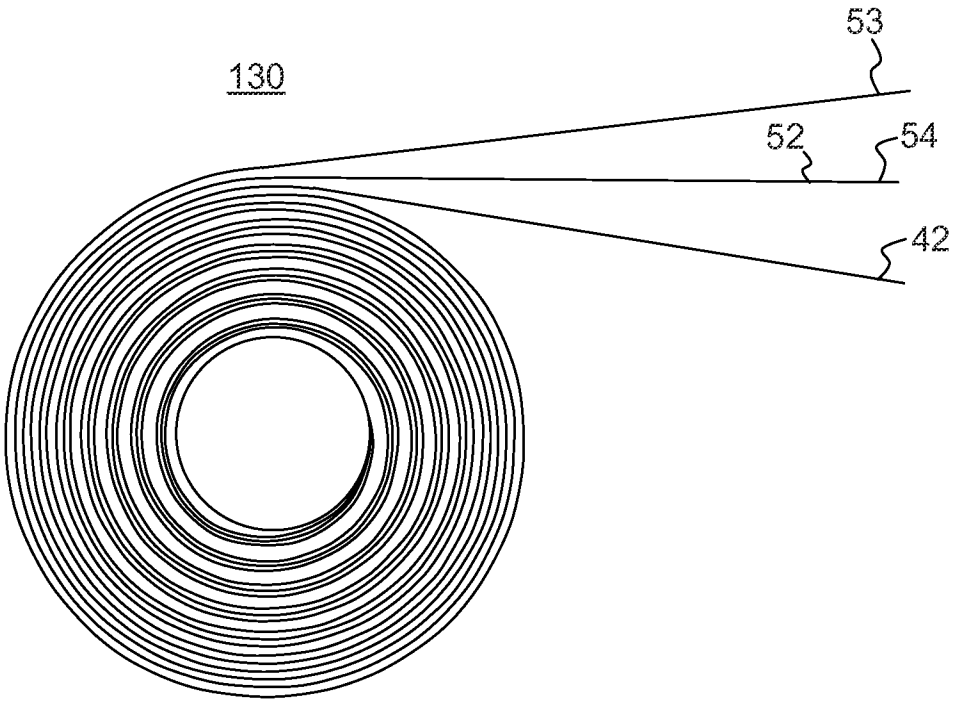
FIG. 9 shows a cross-sectional schematic in the plane XY of a fifth embodiment of the connecting device.

FIG. 9 shows a cross-sectional schematic in the plane XY of a fifth embodiment of the connecting device 130. The connecting device 130 may comprise at least one second tape 52 superposed with the first tape 42 and able to make the transition from a configuration in which it is wound about the axis Z around the support 43 fixed to the first object 40 to a configuration in which it is deployed along the axis X substantially perpendicular to the axis Z, the tape 52 having an end 54 intended to come into contact with a third object (not depicted) so as to connect the first object 40 and the third object. The tape 52 is superposed with the tape 42. Similarly, a third tape 53 may be wound around the support 43, superposed with the tapes 42 and 52. This tape winding configuration is advantageous because it allows several tapes intended to come into contact with several objects to be wound into a minimum amount of space. Likewise, it is possible for the connecting device 130 to comprise four or more tapes superposed on one another and allowing a fifth or more objects to be connected to the first object 40.

Figure 10:
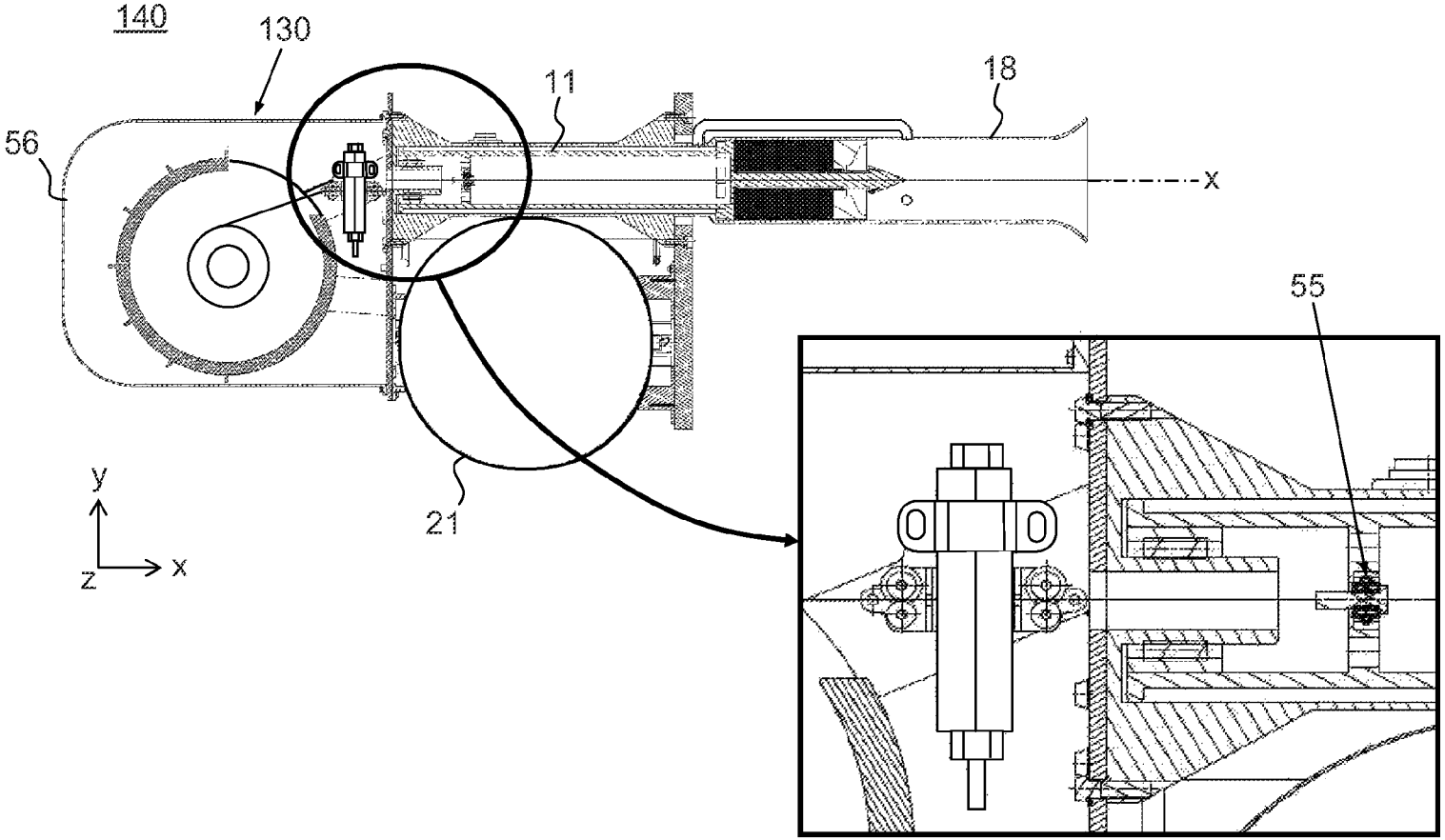
FIG. 10 shows a cross-sectional schematic in the plane XY of a fifth embodiment of the device for launching a projectile according to the invention including a connecting device.

FIG. 10 shows a cross-sectional schematic in the plane XY of a fifth embodiment of a device 140 for launching a projectile using a compressed fluid according to the invention, comprising the barrel 18, a reservoir 21 of compressed fluid connected to the first 19 of the two ends of the barrel 18. The launch device 140 comprises a connecting device 130 described hereinabove the projectile 11 then being the second object 41. The support 43 is fixed to the device 140. The end 44 of the first tape 42 is connected to the second object, namely to the projectile 11, by a connecting element 55. The connecting element 55 is a mechanical component that allows the projectile 11 to rotate about the axis X. It may be a ball bearing allowing the projectile 11 to rotate about the axis X. The support 43 is fixed in the barrel 18. Advantageously, the support 43 is fixed near the first 19 of the two ends of the barrel 18. In other words, the connecting device 130 is positioned in a rear part of the barrel 18, where the compressed fluid enters. Thus, the compressed fluid coming from the reservoir 21 occupies the rear part of the barrel 18. The compressed fluid then enters the barrel 18 at the end 19 thereof then enters the hollow part 14 of the projectile 11 to re-emerge via the vents 15, so as to generate a rotational movement of the projectile 11 on itself and a translational movement of the projectile along the axis X.

Figure 11A:
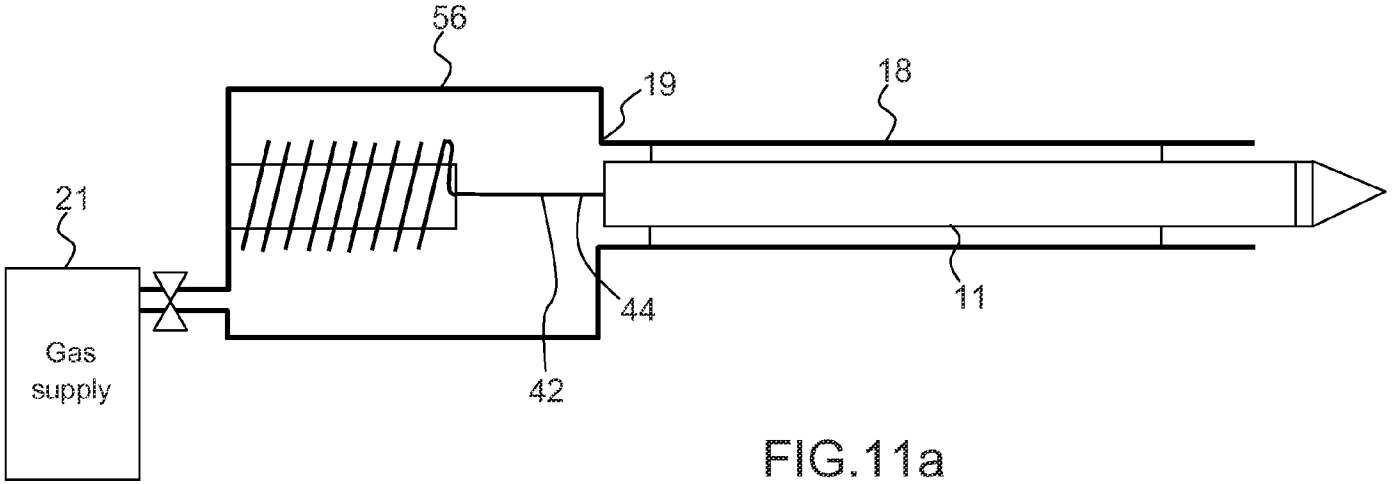
FIGS. 11*a* and 11*b* show cross-sectional schematics in the plane XY of two embodiments of the connecting device.
Figure 11B:
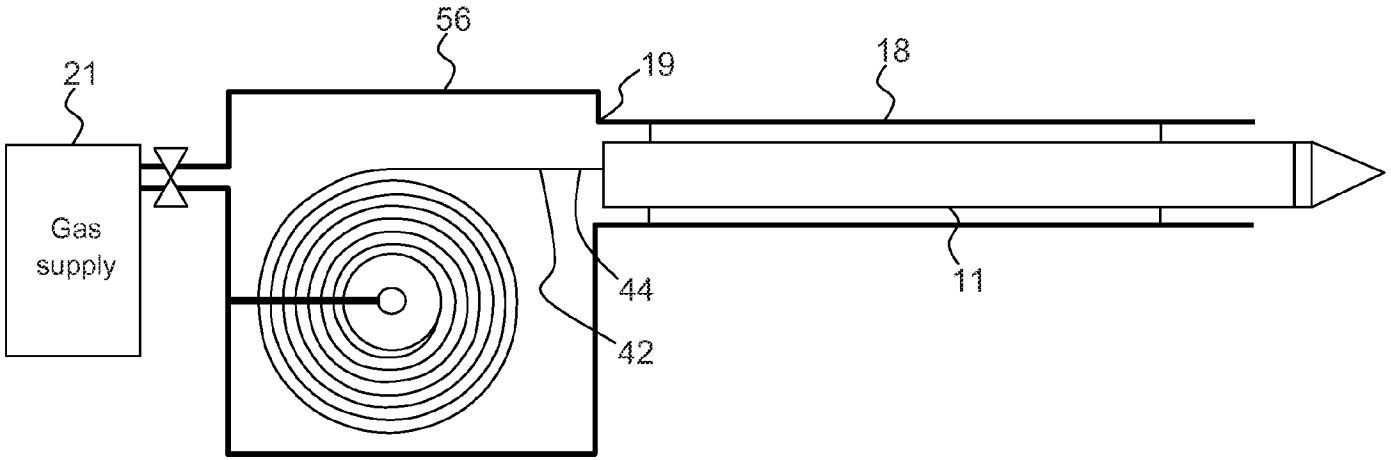

FIGS. 11*a* and 11*b* show cross-sectional schematics in the plane XY of two embodiments of the connecting device 130. As explained previously, the connecting device 130 is positioned in the barrel 18. The end 44 of the tape 42 is fixed to the projectile 11 by the connecting element 55 (not depicted in these figures). In other words, the first object 40 is the barrel 18, the second object 41 is the projectile 11. Thus, the tape 42 while being fixed to the projectile 11 will not disturb the trajectory thereof once the projectile 11 is no longer in the barrel 18. Moreover, because the connection between the tape 42 and the projectile is inside the barrel 18, no leak of fluid, and therefore pressure, can occur.

Figure 12:
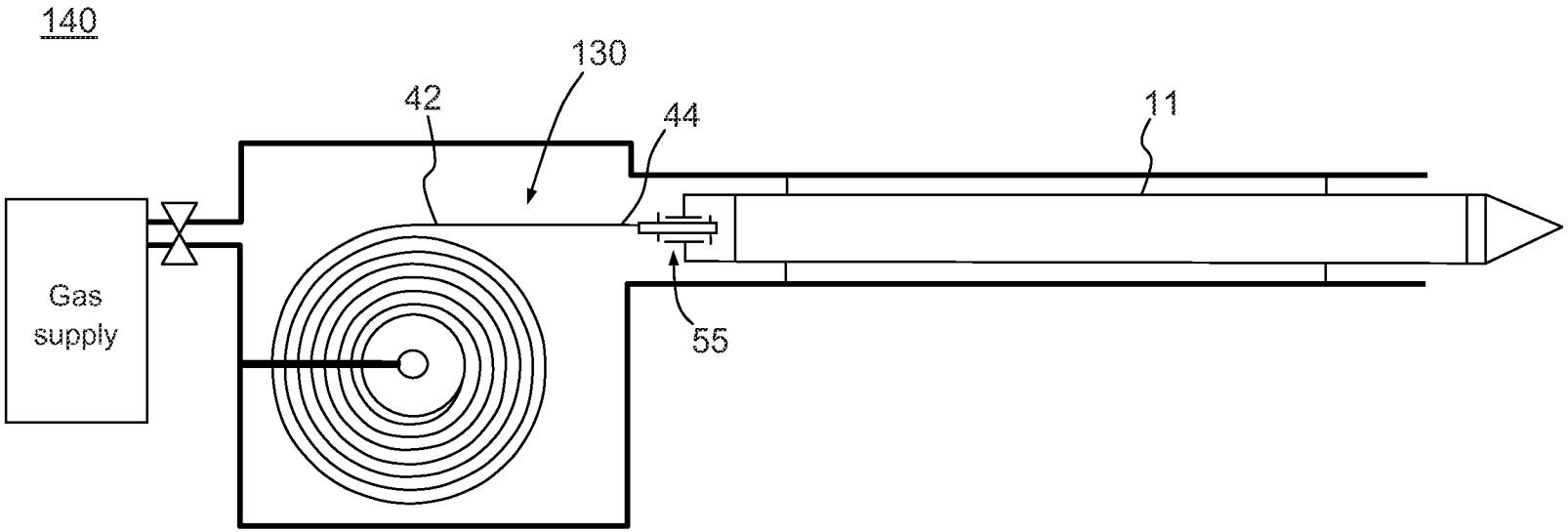
FIG. 12 shows a cross-sectional schematic in the plane XY of a second embodiment of the device for launching a projectile including a connecting device according to the invention.

FIG. 12 shows a cross-sectional schematic in the plane XY of a second embodiment of the device 140 for launching a projectile 11 including a connecting device 130 according to the invention. All the elements of FIG. 12 are identical to the elements of FIG. 11*b*. This embodiment provides a view of the connecting element 55 connecting the end 44 of the tape 42 and the projectile 11, as mentioned earlier in conjunction with FIGS. 11*a* and 11*b*.

The invention claimed is:

1. A device for launching using a compressed fluid, the device comprising:

a projectile including a front end and a back end;

a barrel having a first end and a second end, the projectile being positioned inside the barrel, the first end configured to allow the compressed fluid to enter the barrel, the second end configured to allow the projectile to exit the barrel;

a reservoir of the compressed fluid connected to the first end of the barrel and including a connecting device, wherein the connecting device includes a first tape configured to make a transition from:

a first configuration wound about an axis Z around a support that is fixed in the barrel, to a second configuration deployed along an axis X that is substantially perpendicular to the axis Z, wherein the tape includes an end fixed to the back end of the projectile by a connection element, and wherein the connection element is a mechanical component configured to allow the projectile to rotate about the axis X and allow a portion of the tape including the end of the tape fixed to the back end of the projectile to remain along the axis X.

* * * * *